US006206242B1

(12) United States Patent
Amberg et al.

(10) Patent No.: US 6,206,242 B1
(45) Date of Patent: Mar. 27, 2001

(54) POT WITH A FLEXIBLE STORAGE BARREL AND FOLLOW-UP PLATE

(75) Inventors: Guenther Amberg, Neuss; Wolfgang Huber, Friedolfing; Klaus Rutz, Vachendorf, all of (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/284,296

(22) PCT Filed: Oct. 1, 1997

(86) PCT No.: PCT/EP97/05401

§ 371 Date: May 10, 1999

§ 102(e) Date: May 10, 1999

(87) PCT Pub. No.: WO98/15683

PCT Pub. Date: Apr. 16, 1998

(30) Foreign Application Priority Data

Oct. 10, 1996 (DE) ..... 196 41 750

(51) Int. Cl.[7] ..... B67D 5/00

(52) U.S. Cl. ..... 222/82; 222/1; 222/95; 222/256; 222/386; 222/466

(58) Field of Search ..... 222/306, 386.5, 222/308, 465.1, 466, 256, 260, 1, 95, 83.5, 82

(56) References Cited

U.S. PATENT DOCUMENTS

| | | | | |
|---|---|---|---|---|
| 3,847,304 | | 11/1974 | Cohen | 222/105 |
| 3,987,941 | * | 10/1976 | Blessing | 222/386 |
| 4,162,501 | | 7/1979 | Mitchell et al. | 346/140 R |
| 4,231,492 | * | 11/1980 | Rios | 222/1 |
| 4,889,644 | | 12/1989 | Amberg et al. | 252/8.9 |
| 5,178,305 | * | 1/1993 | Keller | 222/386 |
| 5,405,053 | * | 4/1995 | Zublin | 222/83.5 |
| 5,501,368 | * | 3/1996 | Brandhorst et al. | 222/95 |
| 5,553,740 | * | 9/1996 | King et al. | 222/1 |
| 5,765,724 | | 6/1998 | Amberg et al. | 222/1 |

FOREIGN PATENT DOCUMENTS

| | | |
|---|---|---|
| 44 30 418 | 10/1995 | (DE) . |
| 44 14 708 | 11/1995 | (DE) . |
| 0 295 525 | 12/1988 | (EP) . |
| 0 459 943 | 12/1991 | (EP) . |

* cited by examiner

*Primary Examiner*—Kevin Shaver
*Assistant Examiner*—Melvin A Cartagena
(74) *Attorney, Agent, or Firm*—Wayne C. Jaeschke; Glenn E. J. Murphy; Kenneth Watov

(57) ABSTRACT

The invention relates to a device enabling delivery of a paste from a flexible storage barrel located in a dimensionally stable container. Product is fed to a dosing device which dispenses product under vacuum. A follow-up plate is located on the storage barrel exerting pressure thereon. An opening is located in a central position and surrounds a pressure-sealed connection between the storage barrel and an access passageway to the dosing device.

16 Claims, 1 Drawing Sheet

POT WITH A FLEXIBLE STORAGE BARREL AND FOLLOW-UP PLATE

BACKGROUND

1. Field of the Invention

This invention relates generaly to dispensers for viscous material, and more particularly to a system or apparatus for delivering and guiding a paste from a flexible storage container accommodated in a dimensionally stable container ("pot") downwards into a dispenser operating by reduced pressure.

2. Discussion of Related Art

Liquid to paste-form detergents are well known in the prior art. They are generally formulated to meet domestic requirements, i.e. they are expected to be sufficiently liquid so that they can be poured out and measured/dosed without difficulty. Since, in addition, they are expected to be stable in storage over a relatively broad temperature range, the use of organic solvents and/or hydrotropic additives cannot normally be avoided. However, such additives do not contribute to the actual washing process, are comparatively expensive and, in addition, take up packaging space and transportation and storage capacity. The presence of inflammable solvents is particularly troublesome and necessitates additional safety precautions on account of the relatively high consumption of detergents in laundries. Because of this, detergent concentrates of the type mentioned can only be used to a limited extent, if at all, in laundries.

Accordingly, powder-form detergents are mainly used in laundries. Since the exact dosing of powder-form detergents is problematical or labor-intensive, particularly in large and extensively automated laundries, the detergents are mostly stored and dispensed in predissolved form as stock liquors, i.e. a water-based concentrate is prepared and delivered to the individual points of consumption. However, the detergents typically used in laundries contain comparatively high levels of washing alkalis which are only soluble to a limited extent in cold water and, lead to so called salting-out effects. They promote phase separation with the result that the organic components, more especially the nonionic surfactants and soaps, separate and cream up. Accordingly, the concentrates have to be diluted relatively heavily with water and, in addition, the stock liquors have to be constantly and intensively mixed and circulated to prevent individual components being deposited in the feed lines to the points of consumption. Processes such as these require considerable investment in large mixing vessels and the associated static mixers and feeders, and also require a constant supply of energy for the heating and circulation of the stock liquors.

A detergent which meets these requirements is proposed in EP 0 295 525. This detergent is a paste which imposes particular demands on handling for the purpose of dosing and mixing with water as solvent. Detergent pastes such as these are transported and stored in large containers.

SUMMARY OF THE INVENTION

The technical problem addressed by the present invention is to design a system in such a way that the paste is safely and controllably delivered by simple means. The solution to this problem in one embodiment of the invention includes an opening is centrally positioned and surrounds a pressure-tight connection between a storage container placed in a removable pot above a dispenser, and the access to the dispenser. The paste is guided downward into the dispenser. If the container is flexible, a follower plate is placed on the top of the container within the pot. The follower plate applies pressure on the container to insure substantial emptying thereof. handles are provided on the outside of the pot in the upper part thereof facilitate the handling and exact alignment.

A central recess is provided in the bottom of the follower plate to facilitate the arrangement of the components within or concentric with the central opening of the dispenser which project into the pot. In addition, the bottom of the follower plate is shaped to match the base of the pot to ensure that when the container is almost empty, the peripheral residues of the paste are taken up and forced into the middle where a recess in the plate bottom that forms a space for collecting residues.

If there is a gap between the inside wall of the pot and the edge of the follower plate which is capable of accommodating twice the wall thickness of the flexible container, this advantageously allows an arrangement in which—as emptying of the container progresses—the envelope of the emptied container can be taken up at the edge between the follower plate and the pot without being compressed as the follower plate continues to descend. This prevents the constituent material of the container from crumpling which would be a serious obstacle to complete emptying thereof.

By forming the follower plate with a central bore which opens into the recess, the air displaced into the recess of the follower plate through the bulging out of the flexible container is diverted so that the container is able to spread out freely.

To achieve complete emptying of the container, the follower plate has to be relatively heavy. Its handling is advantageously facilitated by the provision of a handle on the upper part of the follower plate.

BRIEF DESCRIPTION OF THE DRAWINGS

The above-mentioned advantages and other advantages are illustrated by the following description of an embodiment of the invention which is shown in the accompanying drawing in which.

DETAILED DESCRIPTION OF THE INVENTION

Figure 1:
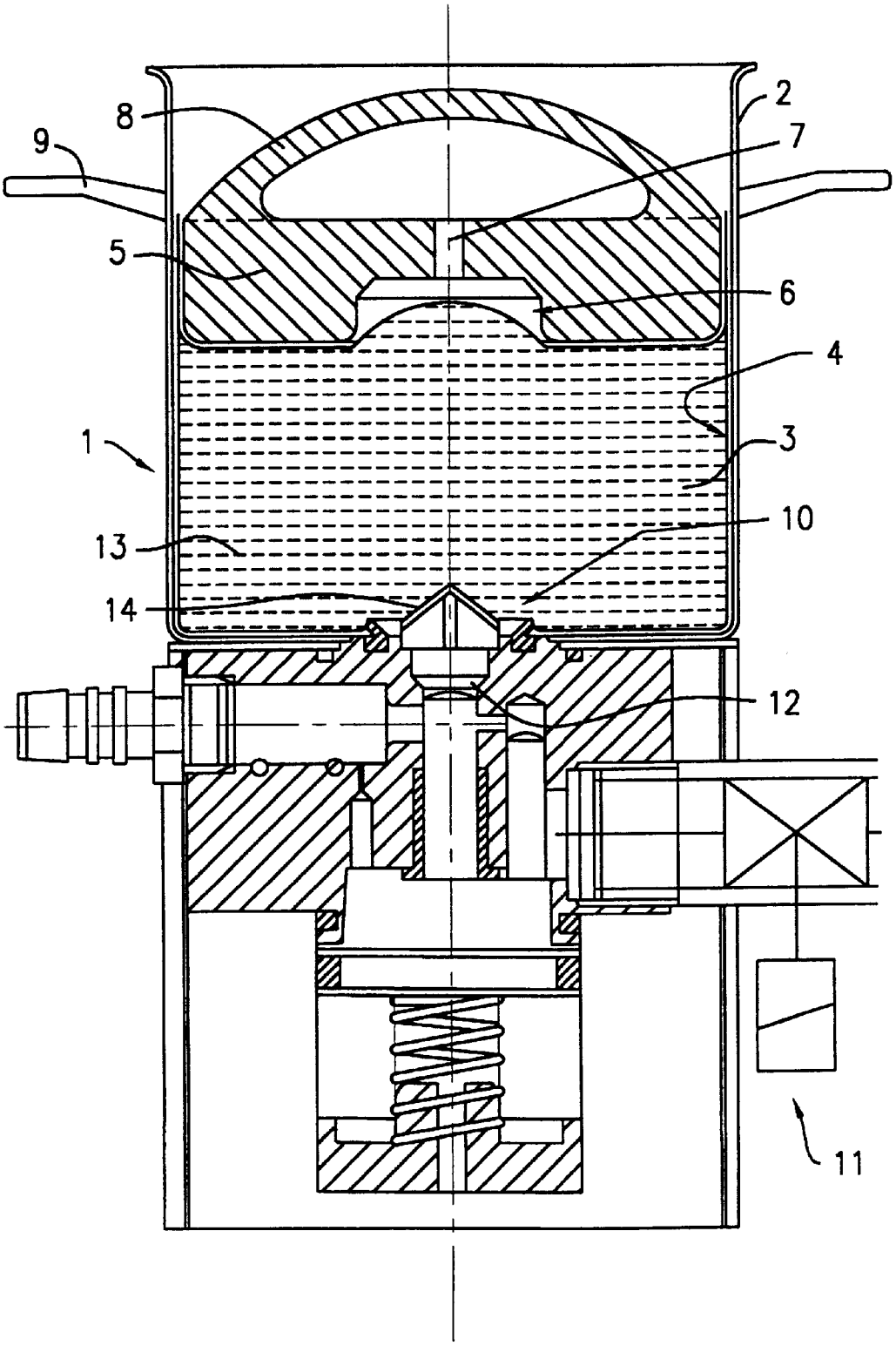
FIG. 1 is a partial cross sectional and cutaway view

The drawing shows an arrangement 1 in which a dimensionally stable pot 2 is placed on the frame of a dispenser 11. The pot 2 has a central opening 10 in its base through which parts of the dispenser 11 project into the pot 2 and which is positioned centrally over the access 12 of the dispenser 11. The pot 2 has handles 9 which facilitate its handling and exact alignment.

Accommodated in the pot in a flexible container 3 in which paste 13 is stored and which, appropriately, is also used for transporting the paste 13. The material of the wall 4 of the flexible container 3 consists of smooth, mostly transparent plastic. Placed on top of the container 3 is a follower plate 5. The bottom of the follower plate 5 is formed with a central recess 6 having a central bore 7. A handle 8 is provided on top of the follower plate 5.

The circumference of the follower plate 5 is selected so that the edge of the follower plate 5 and the inner wall of the pot 2 are separated by a gap which is capable of accommodating twice the thickness of the wall 4 of the flexible storage container 3. This ensures that the envelope of the emptied part of the container 3, adjoining the edge of the pot 2, is guided between the pot 2 and the follower plate 5. The emptied part of the container 3 is thus prevented from crumpling and trapping residues of the paste 13 in the resulting tangle. Above all, the follower plate 5 is able to complete its downward movement to the bottom of the pot 2.

The same purpose is also served by the provision of the central recess 6 in the base of the follower plate 5 in which parts present in the opening 10 and projecting into the pot 2 can be accommodated. In the illustrated embodiment, the parts are a knife 14 with which the material 4 of the flexible container 3 can be automatically cut open on insertion and sealing elements which are arranged at the edge of the opening 10 and which guarantee a tight seal between the flexible container 3 and the access 12 of the dispenser 11.

Although various embodiments of the invention have been shown and described, they are not meant to be limiting. Those of skill in the art may recognize certain modification to these embodiments, which modifications are meant to be covered by the spirit and scope of the appended claims.

What is claimed is:

1. Apparatus for delivering and guiding a paste from a flexible storage container accommodated in a dimensionally stable pot downwards into a dispenser operating by reduced pressure, the flexible storage container being surmounted by a follower plate which applies pressure to the storage container, the follower plate being configured to provide a gap between the inner wall of the pot and an edge portion thereof which is capable of accommodating twice the wall thickness of the flexible container, and an opening being present in the base of the pot, wherein the opening is centrally positioned and surrounds a pressure-tight connection between the storage container and the access of the dispenser.

2. Apparatus as claimed in claim 1, wherein the pot comprises handles on its upper outer surface.

3. Apparatus as claimed in claim 2, wherein the follower plate is formed with a central recess in its lower face which is otherwise shaped to match the base of the pot.

4. Apparatus as claimed in claim 3, wherein the follower plate further includes a central bore which opens into the recess.

5. Apparatus as claimed in claim 2, wherein a top portion of the follower plate further includes a handle.

6. Apparatus as claimed in claim 1, wherein the follower plate is formed with a central recess in its lower face which is otherwise shaped to match the base of the pot.

7. Apparatus as claimed in claim 6, wherein the follower plate further includes a central bore which opens into the recess.

8. Apparatus as claimed in claim 7, wherein a top portion of the follower plate further includes a handle.

9. Apparatus as claimed in claim 6, wherein a top portion of the follower plate further includes a handle.

10. Apparatus as claimed in claim 1, wherein a top portion of the follower plate further includes a handle.

11. Apparatus as claimed in claim 1, wherein a top portion of the follower plate further includes a handle.

12. Apparatus as claimed in claim 1, further including a knife element extending upwardly proximate the opening in the base of said pot.

13. A dispensing apparatus for delivering and guiding a paste from a flexible storage container, said apparatus comprising:

a dimensionally stable pot with upwardly extending sidewalls and a dispenser assembly located at a base portion thereof, said dispenser assembly including a fluid port on a top portion thereof;

a flexible storage container being configured for placement on the top portion of said dispensing assembly within said pot, said container being further configured for fluid connection with the fluid port of said dispenser assembly;

a follower plate disposed on top of said storage container for applying pressure thereto;

a gap capable of accommodating twice the wall thickness of the flexible container, being defined between an inner wall of the pot and an edge of the follower plate; and a knife extending upwardly proximate the opening in the base of said pot for piercing said storage container, whereby the fluid connection between the container and the fluid port is formed.

14. The dispensing apparatus of claim 13, wherein the follower plate is formed with a central recess in its lower face which is otherwise shaped to match the base of the pot.

15. The dispensing apparatus of claim 14, wherein the follower plate further includes a central bore which opens into the recess.

16. The dispensing apparatus of claim 13, wherein said flexible, storage container is composed of a unitary material.

* * * * *